US006170878B1

(12) United States Patent
Cassman

(10) Patent No.: US 6,170,878 B1
(45) Date of Patent: Jan. 9, 2001

(54) NOSAVA TENNIS SCORING SYSTEM

(76) Inventor: Joel Franklin Cassman, 6742 War Eagle Pl., Colorado Springs, CO (US) 80919

( * ) Notice: Under 35 U.S.C. 154(b), the term of this patent shall be extended for 0 days.

(21) Appl. No.: 09/342,241

(22) Filed: Jun. 29, 1999

(51) Int. Cl.[7] ..... G09B 19/00

(52) U.S. Cl. ..... 283/49

(58) Field of Search ..... 283/49, 66.1, 115, 283/48.1, 50

(56) References Cited

U.S. PATENT DOCUMENTS 1,508,067 * 9/1924 Reyes ..... 283/49
5,090,735 * 2/1992 Meaney ..... 283/49 X
5,314,208 * 5/1994 Strickland ..... 283/49 X
5,489,122 * 2/1996 Pittner ..... 283/49

* cited by examiner

*Primary Examiner*—Willmon Fridie, Jr.
(74) *Attorney, Agent, or Firm*—Phillip J. Lee

(57) ABSTRACT

This invention relates to a novel tennis scoring system ("The NOSAVA Tennis Scoring System"). The present invention provides a method by which a permanent record may be maintained of the points scored in a tennis match by each player, the means by which such score was made and the results of each game, set and match. This information provides a detailed permanent record of the match for the benefit of the tennis player, coach or parent. The scoring system consists of a matrix of boxes in rows on each page. Each box, bisected by a diagonal line, represents a point scored for either player or team. Each row of boxes represents a game. Each page represents a set. A scoring key appears at the top of the page with various codes indicating the manner by which the point was scored. A point won by a player or team is marked by writing the appropriate code letter in the upper left triangle of the box in the game line, while each point won by the opposing player or team is marked by writing the appropriate code letter in the lower right triangle of the box. After a game is completed, the appropriate upper left or lower right triangle of the last box in the row is shaded to indicate the winner of the game. This system serves to provide the correct game score throughout the set and match. Multiple pages of the scoring system may be inserted in a booklet and bound to provide an ongoing permanent record of the player's competitive tennis experience.

9 Claims, 1 Drawing Sheet

NOSAVA TENNIS SCORING SYSTEM

BACKGROUND OF THE INVENTION

A. Field of Invention

The present invention relates generally to score keeping for the sport of tennis and particularly to a scoring system ("The NOSAVA Tennis Scoring System") for providing a detailed permanent record of each score in a tennis match and a method of keeping score during a match using said scoring system.

B. Description of Related Art

Traditionally, tennis players keep track of the points in a game mentally. Game score and set score are often recorded by simple score boards. While this traditional system ordinarily serves its purpose of determining the winner of the match, much useful information is lost by failing to record the details of the games. Without a permanent detailed record, review of the points in a match by player and coach for purposes of coaching improvement relies on memory and indefinite impressions, both of which may be inaccurate. Accordingly, there is a need for a means of keeping a detailed record of a tennis match that can be used simply, quickly and conveniently.

SUMMARY OF THE INVENTION

The present invention provides a scoring sheet and method by which a permanent record may be maintained indicating each point won by the player (or team in doubles play) and each point won by the opponent (or opposing doubles team). The scoring method also records how the point was won by marking the appropriate code selected from a scoring key. The scoring system also provides a means to record the results of each game and thereby maintain an accurate game score during the set and the match. This information provides a detailed permanent record of the match for the benefit of the tennis player, coach or parent.

The scoring system consists of a sheet, or series of sheets of paper or other suitable material, including electronic means, on which there is printed or recorded a matrix comprising thirteen rows of eight or more rectangular boxes. Each box, bisected by a diagonal line, represents a point scored for either player (or doubles team). A point won by a player or team is marked by writing the appropriate code letter in the upper left triangle of the box, while each point won by the opposing player or team is marked by writing the appropriate code letter in the lower right triangle of the box. The score entry boxes are arranged in columns labeled to correspond to the traditional scoring points in the sport of tennis. Thus, the first column of boxes is labeled "15", the second column is labeled "30", the third column is labeled "40", the next four boxes are labeled "AD" and the last column is labeled "WIN".

Each row of boxes in the scoring sheet represents a game and is consecutively numbered on the left side of the score sheet. This number is circled in order to indicate that the player (or team) is the serving side during that game. Upon completion of a game, the appropriate triangle in the last box in the row is shaded to indicate the winner of the game. This will serve to provide the correct game score throughout the set and match.

Each page in the scoring sheet represents a set. At the bottom of the page, there is an additional row of seven boxes in the event that a tie-break is employed in order to determine the winner of a set which is tied in games. The method of tie-breaks used by this scoring system is to award the set to the player who wins at least seven points and has at least a two point advantage over the opponent during the tie-break play. Beneath this final row of boxes, there is a space to record the set score. Multiple pages of the scoring sheet may be inserted in a booklet and bound to provide an ongoing permanent record of the player's competitive tennis experience.

At the top of each score sheet, there are spaces for identifying information about the set and match. A scoring key is printed on the score sheet to indicate the codes by which the points are scored. The scoring key is intended to provide a logical, convenient and simple code for recording the manner in which the point was won.

The principal aim of the present invention is to provide a convenient and simple tennis score sheet and method of keeping score which meets the foregoing requirements and which provides a permanent record of useful information for coaching improvement purposes in addition to the final score of the match.

Other objects and advantages of the invention will become apparent from the Description of the Preferred Embodiments and the Drawings and will be in part pointed out in more detail hereinafter.

DESCRIPTION OF THE PREFERRED EMBODIMENT

Figure 1:
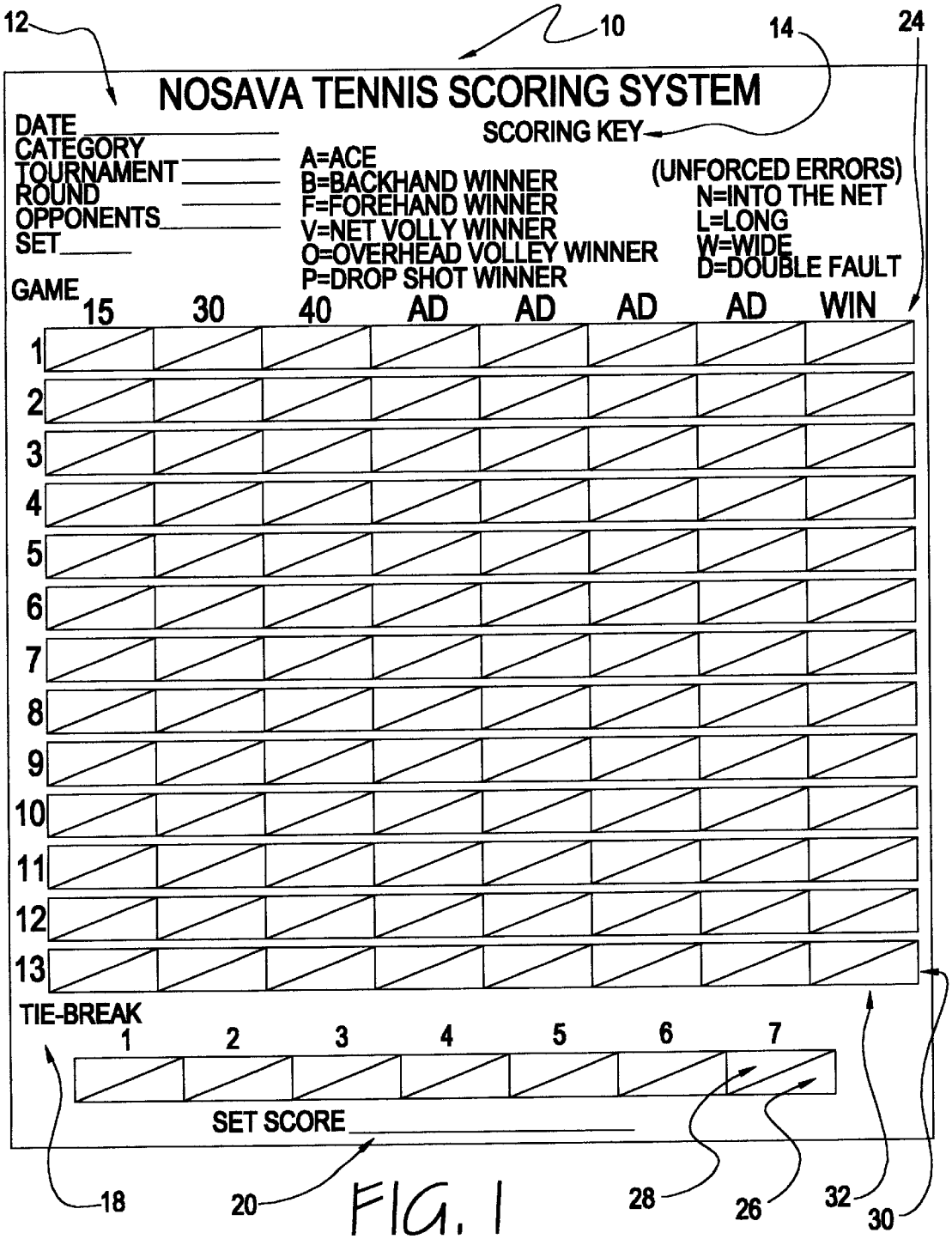
FIG. 1 is a front view of the tennis score sheet in accord with the present invention.

Referring to the drawing in FIG. 1, a tennis score sheet of the present invention is depicted in a slightly reduced scale and generally designated by the numeral 10. Tennis score sheet 10 is a flat piece of paper or other suitable material, including electronic means, on which there is printed or recorded a section 12 for recording identifying information about a tennis set, including "DATE", "CATEGORY", "TOURNAMENT", "ROUND", "OPPONENTS", and "SET".

Tennis score sheet 10 further comprises a section 14, labeled "SCORING KEY" in which a code is provided with various letters depicting the manner by which a point may be scored. In the illustrated preferred embodiment, the scoring key section 14 provides: "A=Ace", "B=Backhand winner", "F=Forehand winner", "V=Net volley winner", "O=Overhead volley winner", "P=Drop Shot winner", "(Unforced Errors)", "N=Into the Net", "L=Long", "W=Wide", and "D=Double Fault". The majority of the space on tennis score sheet 10 comprises a matrix 16 comprising thirteen rows, each row 30 comprising eight score entry boxes 24. Each rectangular score entry box 24 is bisected by a diagonal line 22 from the bottom left corner to the upper right corner. In the preferred embodiment, each score entry box 24 consists of a upper left triangle 26 and a lower right triangle 28. Each score entry box 24 is arranged in one of eight columns 32 corresponding to the position of the particular box 24 in the row 30 and each column 32 is labeled at the top to correspond to the traditional score points in a game of the sport of tennis. The first column 32 from the left side of tennis score sheet 10 is labeled "15", the second column 32 is labeled "30", the third column 32 is labeled "40", the next four columns 32 are labeled "AD", and the last column 32 is labeled "WIN". Each row 30 of boxes represents a game and is consecutively numbered on the left hand side of score sheet 10 from "1" to "13".

Near the bottom of score sheet 10 is an additional row 18 labeled "TIE-BREAK" consisting of seven boxes numbered consecutively "1" to "7". At the bottom of score sheet 10 there is a space 20 for recording the set score.

The method of keeping score by means of the score sheet of the present invention comprises determining which player won the point and by what means the point was won and entering the appropriate code letter for the means of winning the point from the scoring key 14 into the appropriate score entry box 24. If the player keeping the score, or on whose behalf the score is kept, wins the point, the upper left triangle 26 of the score entry box 24 for the point scored should be marked with the appropriate letter code. If the opposing player wins the point, the lower right triangle 28 of the score entry box 24 for the point scored should be marked with the appropriate letter code. A dot may be inserted in the lower left corner of each score entry box 24 to indicate that the first serve was out. After the final point in a game is completed, the appropriate triangle 26 or 28 of the last score entry box 24 in the row 30 corresponding to the current game is shaded in, which records the winner of that game.

Multiple pages of the scoring sheets 10 may be inserted or bound in a booklet to provide an ongoing permanent record of a player's competitive tennis experience.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention. In particular, it will be anticipated that a variety of materials and sizes, including electronic means, could be utilized for the tennis score sheet 10. Further, other coding of the scoring key could be used if desired; or the key could be ignored and winning points recorded by placing any sort of mark in the appropriate triangle of the score entry boxes. Thus the teachings of the invention are not restricted solely to the exact embodiment shown herein.

What I claim as my invention is:

1. A method of creating a permanent and detailed record of each scoring event in a tennis match comprising the steps of:

A. dividing at least a portion of a flat markable surface into a matrix comprising thirteen rows of eight score entry boxes, and B. dividing each score entry box into a section for the serving player's score and a section for the receiving player's score, and C. using one row for each game played, beginning at first entry box to the left and proceeding successively to the right, marking each player's score entry box section with a selected symbol representing the particular manner in which the player achieved each score, and D. reiterating the foregoing steps for each set played in the match.

2. The tennis score record creating method of claim 1, further comprising arranging the score entry boxes in eight columns and labeling each column is to correspond to the score points in a game of tennis.

3. The tennis score record creating method of claim 2, wherein the division of each score entry box into two sections comprises dividing each score entry box with a diagonal line.

4. The tennis score record creating method of claim 3, further comprising printing a scoring key section comprising symbols representing the common types of scoring events.

5. The tennis score record creating method of claim 4, further comprising labeling the first column of score entry boxes "15", labeling the second column "30", labeling the third column "40", and labeling the next four columns "AD", and labeling the last column "WIN".

6. The tennis score record creating method of claim 5, further comprising consecutively numbering each row of boxes on the left hand side thereof.

7. The tennis score record creating method of claim 6, further comprising printing a row of seven consecutively numbered score entry boxes labeled "TIE-BREAK" on the surface.

8. The tennis score record creating method of claim 7, further comprising printing spaces for recording the set score, the date, place, set number and opponent name on the surface.

9. The tennis score record creating method of claim 8, wherein the step of printing the scoring key section comprises printing symbols representing scoring events including ace, backhand winner, forehand winner, "V=Net volley winner", "O=Overhead volley winner", "P=Drop Shot winner", "(Unforced Errors)", "N=Into the Net", "L=Long", "W=Wide", and "D".

* * * * *